United States Patent [19]

Pou et al.

[11] Patent Number: 4,516,497

[45] Date of Patent: May 14, 1985

[54] PRINTER WITH AUTOMATIC STACKER

[75] Inventors: Frederick M. Pou, Dayton; Richard L. Straub, Miamisburg, both of Ohio

[73] Assignee: Monarch Marking Systems, Inc., Dayton, Ohio

[21] Appl. No.: 575,942

[22] Filed: Mar. 26, 1984

Related U.S. Application Data

[62] Division of Ser. No. 393,674, Jun. 30, 1982, Pat. No. 4,442,774.

[51] Int. Cl.[3] ..... B41F 13/64

[52] U.S. Cl. ..... 101/240; 198/502; 271/216; 209/564

[58] Field of Search ..... 270/52, 58; 101/236–241, 226; 271/216, 198–201; 198/419, 423, 462, 502, 503; 209/3.3, 563, 564

[56] References Cited

U.S. PATENT DOCUMENTS 3,762,320 10/1973 Johne et al. ..... 101/240 X
3,817,175 6/1974 Heiber et al. ..... 101/240
4,054,092 10/1977 Loftus et al. ..... 101/239 X
4,210,078 7/1980 Greiner et al. ..... 101/240 X
4,372,696 2/1983 Pou ..... 400/124

*Primary Examiner*—S. H. Rickholz
*Attorney, Agent, or Firm*—Mason, Kolehmainen, Rathburn & Wyss

[57] ABSTRACT

A printing system for printing characters in various fonts and formats onto webs of sheet stock of various sizes includes apparatus for cutting the web into various lengths to accommodate various formats as well as for providing different lengths of tags which are interposed between batches of tags to permit easy separation of the batches. A stacker is also provided which selectively stacks the tags in a shingle fashion or into piles. Circuitry is provided to detect jams in the system and to assure that the proper size web corresponding to the selected format is used. Also, the system is provided with circuitry for adjusting the line print position to compensate for positioning errors caused by mechanical tolerances in the printers.

7 Claims, 14 Drawing Figures

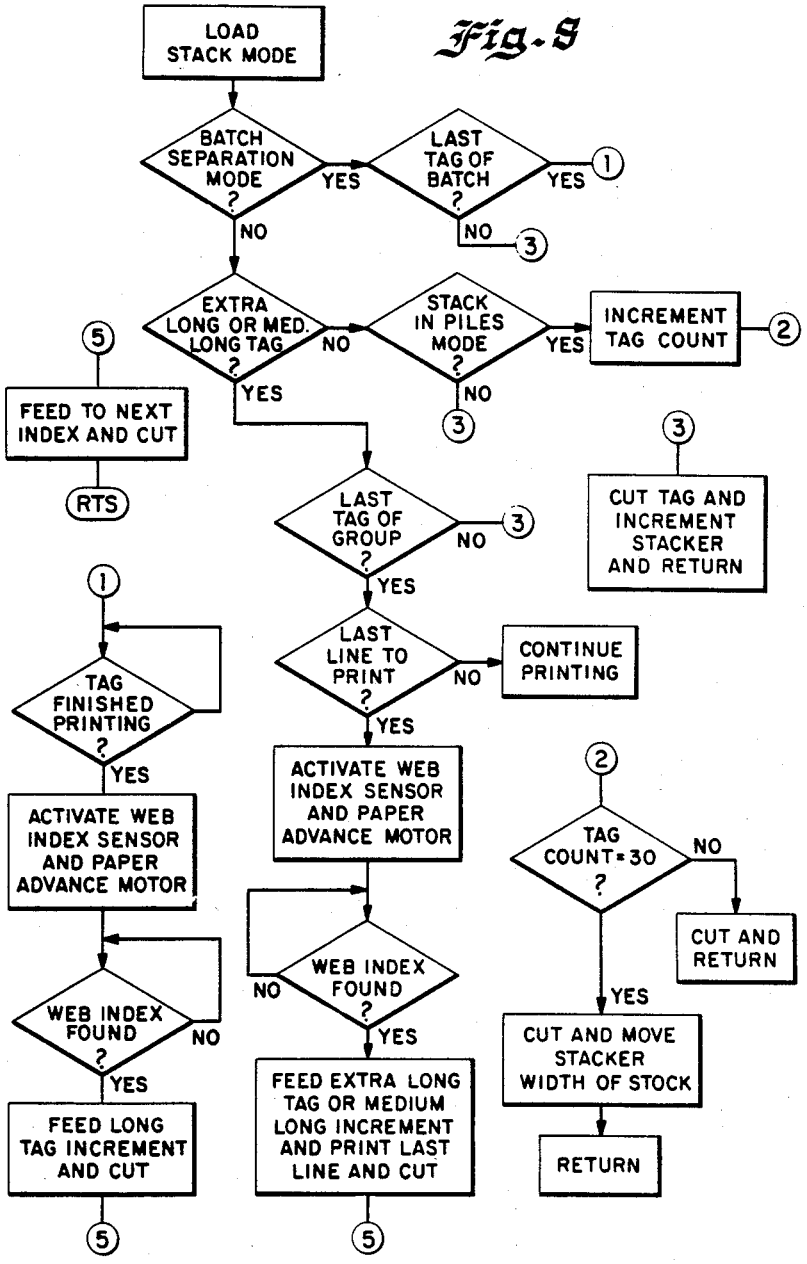
Fig. 9
LOAD STACK MODE
BATCH SEPARATION MODE ?
YES
NO
LAST TAG OF BATCH ?
YES
NO
1
3
EXTRA LONG OR MED. LONG TAG ?
NO
YES
STACK IN PILES MODE ?
YES
NO
INCREMENT TAG COUNT
2
3
5
FEED TO NEXT INDEX AND CUT
RTS
LAST TAG OF GROUP ?
NO
YES
3
CUT TAG AND INCREMENT STACKER AND RETURN
1
TAG FINISHED PRINTING ?
YES
ACTIVATE WEB INDEX SENSOR AND PAPER ADVANCE MOTOR
WEB INDEX FOUND ?
NO
YES
FEED LONG TAG INCREMENT AND CUT
5
LAST LINE TO PRINT ?
NO
YES
CONTINUE PRINTING
ACTIVATE WEB INDEX SENSOR AND PAPER ADVANCE MOTOR
WEB INDEX FOUND ?
NO
YES
FEED EXTRA LONG TAG OR MEDIUM LONG INCREMENT AND PRINT LAST LINE AND CUT
5
2
TAG COUNT=30 ?
NO
YES
CUT AND RETURN
CUT AND MOVE STACKER WIDTH OF STOCK
RETURN

PRINTER WITH AUTOMATIC STACKER

CROSS-REFERENCE TO RELATED APPLICATION

This is a divisional patent application of copending patent application Ser. No. 393,674, filed on June 30, 1982 now U.S. Pat. No. 4,442,774.

BACKGROUND OF THE INVENTION

1. Field of the Invention

This invention relates generally to printing systems, and more particularly to printing systems for printing characters in various fonts and formats onto webs of sheet stock of various widths, for cutting the web to various lengths to accommodate the various formats and for automatically stacking the tags after they are cut.

2. Description of the Prior Art

Printers capable of printing characters in various fonts and formats onto webs of various sizes are known. One such printer is described in U.S. patent application Ser. No. 151,577 filed by Frederick M. Pou on May 20, 1980, now U.S. Pat. No. 4,372,696, incorporated herein by reference.

While prior art printers such as the one described in the aforementioned U.S. Pat. application Ser. No. 151,577 do provide a way to print characters of various fonts and formats onto various size webs of sheet stock, such printers can be augmented to incorporate additional features. The prior art printers generally print the required information onto the web in the desired format and then cut the web into tags of a predetermined length containing one or more tag sections. For purposes of discussion each section thus cut will be referred to as a tag regardless of the number of tags actually printed on the section. The individual tags printed on each tag will be referred to as tag sections. Moreover, since the printer according to the invention is capable of printing onto various types of web stock including, for example, stock that can be cut into labels, cards or the like, the term tags is intended to cover sections cut from various web stock, and is not limited to merchandise tags.

In a typical printer, after the tags are printed and cut, they exit the printer through a conduit such as a chute, and when a stacker is used, are expelled onto a conveyor belt within the stacker. Afterward the tags are removed from the stacker in stacks. In such stackers, the tags may be stacked in a shingle mode or in piles. However, the stacking mode cannot be readily altered, and in the stacking in piles mode, the spacing between the piles must be great enough to accommodate the widest tags that are printed. This results in a reduction in stacker capacity for narrow tags.

The tags are generally printed in batches ranging from a few tags to hundreds of tags per batch. Typically, the tags in each batch are very similar in size and shape, and differ from tags in other batches only by an item of information, such as, for example, a price or item code. Consequently, because of the physical similarity of the tags of different batches, it is difficult and time consuming for the operator to separate the various batches of tags, and frequently the operator is required to read a large number of tags in order to make the separation.

In the prior art printers, when one or more tags become lodged in the exit conduit or chute, printing is terminated when the jam is detected. Unfortunately, in many instances, the jam is not detected until a large number of tags back up in the chute. However, because the number of tags present in the chute at the time the printing is terminated is generally much larger than the number of tags in a typical batch, tags from several batches become mixed up in the chute. These tags must then be manually resorted by the operator into their proper order in the various batches before printing can be resumed. This results in a considerable delay in the printing process.

In the prior art printers the wrong size web for a given format can be loaded into the printer and result in the printing of wrong size tags for a given format. When the web used is too wide for the selected format, the result is that many tags may be wasted before the error is detected. In the case where the web is too narrow for the selected format, damage to the printing head or other machine components can occur. Such damage can be costly both in terms of the actual cost of repair to the machine, and in lost production while the machine is down.

In the prior art printers, the position at which the various lines are printed on a tag varies from printer to printer as a result of mechanical tolerances. While in many instances, the variation in line print position may not be objectionable, in other instances, it can be significant, particularly when multiple printers are being operated simultaneously, and the tags from the various printers can be readily compared.

The stackers associated with the prior art printers are generally able to stack in only a single mode (either a shingle mode or a stack in piles mode), even though, in many instances, it is desirable to change the stacking mode of a stacker to accommodate various tags or operating conditions.

SUMMARY OF THE INVENTION

Accordingly, it is an object of the present invention to provide an improved printer that overcomes many of the disadvantages of the prior art printers.

It is yet another object of the present invention to provide a printer-stacker combination that offers greater flexibility of operation than prior art printer-stacker combinations.

It is still another object of the present invention to provide a printing system that facilitates the separation of individual batches of items being printed.

It is yet another object of the present invention to provide a printing system that inserts tags of different lengths between batches of tags to facilitate separation of the batches.

It is yet another object of the present invention to provide a printing system that permits separation of the various printed tags into groups and subgroups with the groups of tags being separated by a tag of different length than the printed tags, and the subgroups being separated by a tag of different length than the tag separating the groups.

It is yet another object of the present invention to provide a printer-stacker combination that permits the stacking mode to be readily altered.

It is another object of the present invention to provide a printing system that rapidly detects a jam in the exit conduit or chute in order to maintain sequence integrity of the output tags.

It is yet another object of the present invention to provide a printer that prevents information from being printed on incorrect size stock.

It is yet another object of the present invention to provide a printing system that indicates to the operator the correct size stock required for a particular printing operation.

It is yet another object of the present invention to provide a printer that prints the correct or required size stock onto incorrect size stock when incorrect size stock is used.

It is yet another object of the present invention to provide a printer that checks the length and width of the stock loaded therein and suspends the printing operation if incorrect stock is used.

It is yet another object of the present invention to provide a stacker that provides for the stacking of various width tags in piles at maximum density along its conveyor belt by varying the spacing between piles in accordance with the width of the tags being printed.

It is yet another object of the present invention to provide a stacker that will not stack tags from more than one batch in a single pile.

It is still another object of the invention to provide a printer that electronically adjusts print line position to compensate for mechanical tolerances of the printer.

Therefore, in accordance with a preferred embodiment of the invention there is provided a printer that inserts an extended length tag followed by a reduced length tag between the various batches of tags printed to facilitate the separation of the batches. In addition, a second extended length tag, which is longer than the extended length tag used between batches, followed by a second reduced length tag that is shorter than the reduced length tag utilized between batches is inserted between groups of batches to permit the batches to be separated into groups of related batches. Also, space is provided at the top of the second extended length tags to permit information identifying the group of batches immediately following each second extended length tags to be printed thereon by the printer. If desired, other extended length tags that have lengths that are different than the lengths of the above-mentioned extended length and second extended length tags may be provided if additional levels of separation are desired.

A sensor is provided within the exit conduit or chute to sense the presence of a tag in the chute. The aforementioned sensor cooperates with an event counter to count the number of tags delivered to the chute after the presence of a tag within the chute has been sensed, and acts to terminate the printing of additional tags after the count in the event counter reaches a predetermined number, preferably two or three. By thus limiting the number of tags that can be present in the exit conduit or chute to a relatively low number, the disruption of sequence integrity that occurs when the chute is filled with a large number of tags as a result of a blockage or jam in the chute is avoided.

In order to avoid the problems that occur when the wrong size web is placed in the printer, information defining the lengths and widths of the tags required for each format is stored in the machine. Whenever a new format is selected, this information is printed onto whatever web stock is in the machine in a format small enough to fit on the smallest stock that can be used with the machine. The information is read by the operator who loads the required web stock, or if the stock in the machine is the correct stock, indicates to the machine by pushing a load or a start button that the stock presently in the machine is the correct stock. When the correct web is loaded, or the load or start button depressed, printing can commence; however, as an added check, indices indicative of tag length are disposed on the web at spaced intervals, and the spacing between the indices is compared with the stored value of tag length to determine whether the correct web has indeed been loaded. If so, printing is permitted to continue, but if not, the printing operation is terminated. This serves as an additional check on the operator.

The stacker is controlled by the machine to allow the tags to be stacked either in piles or in a shingle mode under the control of the operator, depending on which mode is desired. When the pile stacking mode is selected, the conveyor belt of the stacker is maintained stationary until a predetermined number of tags are stacked, after which the conveyor belt is incrementally advanced and the next pile is stacked. The increment that the conveyor belt is advanced is determined by the width of the tag being printed in order to optimize the capacity of the stacker. If the end of a batch is reached before a full stack has been stacked, the conveyor belt is advanced so that the new batch of tags is stacked on a new pile in order to assure separation between batches.

Logic is provided to adjust the print position of the various lines to compensate for mechanical tolerances in the printer.

BRIEF DESCRIPTION OF THE DRAWING

These and other objects and advantages of the present invention will become readily apparent upon consideration of the following detailed description and attached drawing wherein:

FIGS. 8–12 are functional flow charts illustrating the logical operation of the control circuitry of the stacker-printer according to the invention;

DETAILED DESCRIPTION OF THE PREFERRED EMBODIMENT

Figure 1:
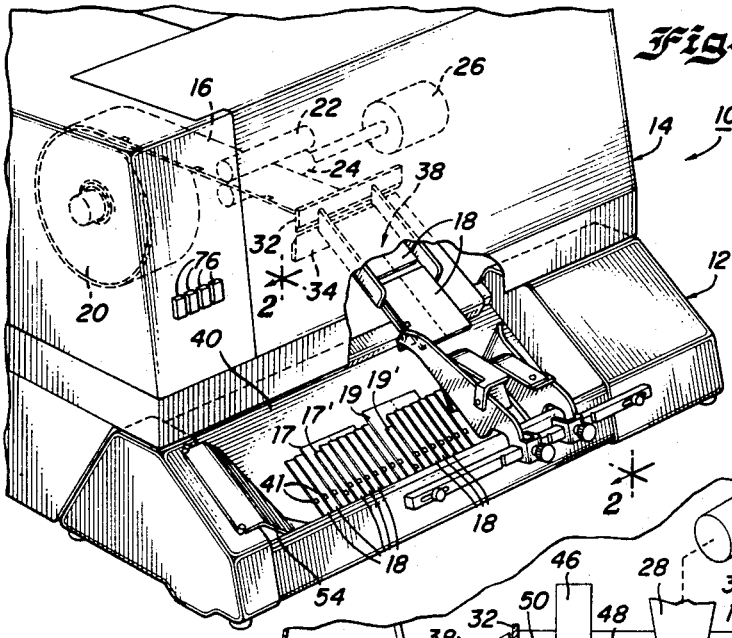
FIG. 1 is a partially simplified perspective view of the stacker-printer according to the invention.

Referring now to the drawing, with particular attention to FIG. 1, the stacker-printer according to the invention is generally designated by the reference numeral 10. The stacker-printer 10 according to the invention includes a stacker portion 12 and a printer portion 14. The printer portion 14 is similar to the printer illustrated in the aforesaid U.S. patent application Ser. No. 151,577, and for this reason is illustrated in simplified and diagrammatic form. The function of the printer 14 is to print alphanumeric characters onto a web of sheet stock 16 that is subsequently cut into a plurality of tags 18 that are stacked by the stacker 12. The web 16 is stored on a roll 20 and advanced through a printing station (not shown in FIG. 1) by a pair of rollers 22 and 24, one or both of which may be driven by a paper advance motor 26, which is preferably a stepping motor.

The printing on the sheet stock occurs at a printing station which includes a print head 28, which preferably includes a matrix type wire printer, but may be a thermographic or any other suitable type of print head. The print head is moved across the web stock 16 in a direction transverse to the longitudinal axis of the web 16 by a carriage driver motor 30 which is also preferably a stepping motor. After being printed, the web stock 16 is advanced to a cutting station having a pair of cutter blades 32 and 34, one or both of which may be driven by a cutter driver 36 which activates the cutter blades at predetermined intervals to cut the web 16 into tags 18 of a length determined by the format of the tag being printed. After the web stock has been cut into the tags 18, the tags exit through an exit chute or conduit 38 onto a conveyor belt 40 of the stacker 12.

In accordance with an important aspect of the present invention, the length to which the tags 18 may be cut is variable, not only to accommodate different formats, but also to provide a separation between batches of tags, as well as groups of batches. When tags are printed, the operator is given a written order defining the tags to be printed. The order typically has an order number or some other form of identification associated with it that defines the batches of tags to be printed. For example, an order may state that a batch of 100 tags of a certain format is required. Additional information for that batch can include, for example, price, an item code, and possibly a description of the item, such as, for example, a size 12 red dress. The operator reads the order and enters the pertinent information defining the batch into the printer, and proceeds with the printing.

Figure 3:
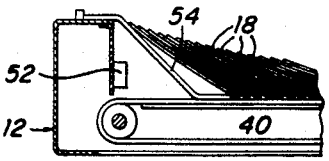
Figure 5:
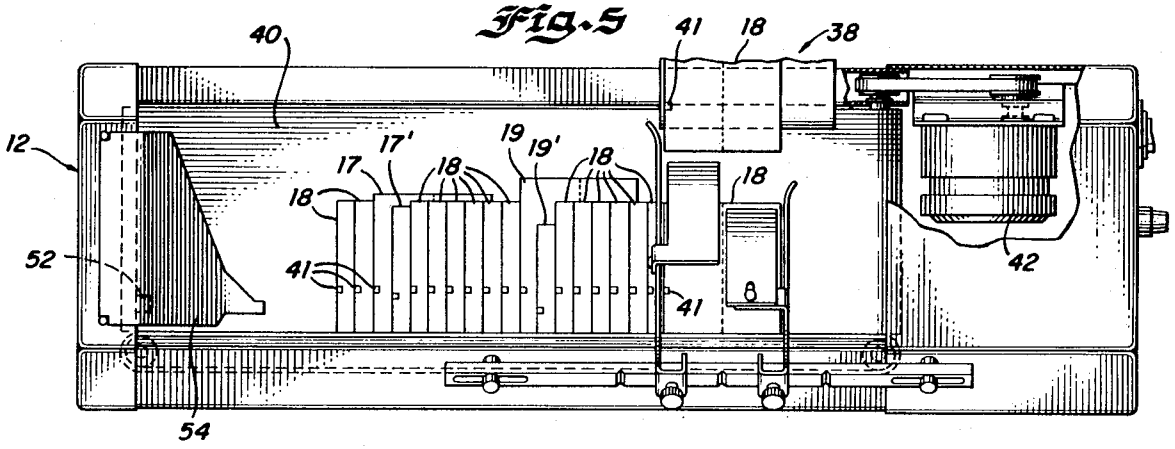
FIG. 5 is a top view of the stacker, partially in cross section, taken along line 5—5 of FIG. 2.

Once printing is initiated, the operator reads the information defining the next batch of tags, which may be a 50 tag batch having a price for a size 8 blue dress. The operator proceeds to enter all of the information defining each batch until the complete order is entered. The operator then proceeds to the next order and enters it in a similar manner. The printer then prints the various batches of tags in the same sequence in which they were entered, and outputs the tags through the exit chute or conduit 38, and onto the conveyor belt 40. The conveyor belt 40 is driven by a motor 42 (FIG. 5), which may be any suitable motor, but is preferably a stepping motor. The conveyor belt 40 can be moved intermittently by the motor 42 to stack the tags in piles (FIG. 13), or moved continuously to stack the tags 18 in a shingle fashion as illustrated in FIGS. 1 and 3. After the tags are stacked, they are periodically removed from the conveyor belt 40 by the operator and packed with their respective orders.

Figure 6:
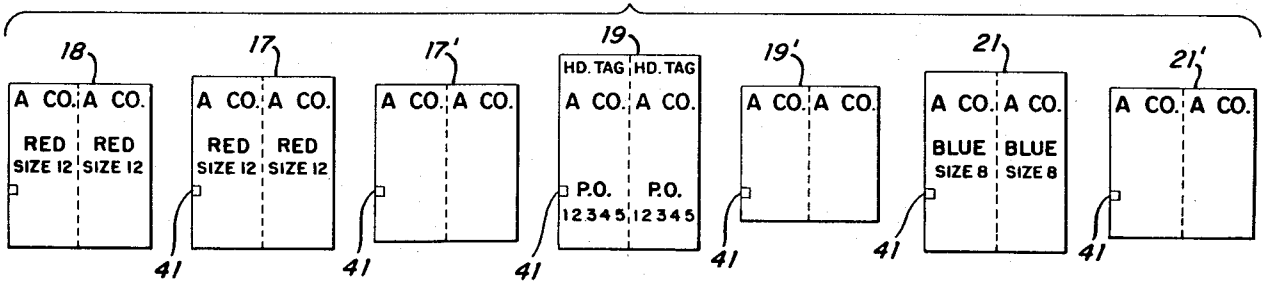
FIG. 6 is an illustration of the various tags that can be printed by the system according to the invention.

In many instances, the tags of the various batches are very similar to each other, particularly batches from a single order. Thus, to facilitate the separation of the batches, the device according to the invention inserts a tag 17 that is longer than the tags 18 comprising the batch after all the tags 18 comprising the batch have been printed. The long tag 17 is followed by a short tag 17' (FIGS. 1 and 6) that is shorter than the tags 18 comprising the batch. Typically, the short tag 17' is shorter than the batch tags 18 by an amount equal to the amount that the long tag is longer than the batch tags. Thus, if the long tag 17 were, for example, $\frac{1}{8}''$ longer than the tags 18 comprising the batch, the short tag 17' would be $\frac{1}{8}''$ shorter. The reason for this relates to the use of tag length indicating indices 41 on the web 16, and prevents misregistration of subsequently printed tags because the total length of the shorter tag and the longer tag is equal to the length of two normal batch tags. This relationship is best illustrated in FIG. 6 which shows the tags arranged with the indices and a preprinted logo A CO. aligned in a straight line relationship. Thus, it can readily be observed that any length added above A CO. is subtracted from the distance between the index 41 and the bottom of a subsequently printed tag.

In addition to separating the various batches, the operator must also separate the various orders. Such separation is facilitated by the stacker-printer according to the invention by inserting an extra long tag 19 that is longer than the long tags 17 between tags of different orders. The extra long tag 19 is likewise followed by an extra short tag 19' that is shorter than the normal batch tag 18 by an amount equal to the amount by which the extra long tag is longer than the normal batch tags. Thus, for example, if the extra long tag 19 separating the batches of an order were $\frac{1}{2}''$ longer than the normal batch tags, the extra short tag would be $\frac{1}{2}''$ shorter to avoid misregistration of subsequently printed tags. This relationship is readily apparent from FIG. 6.

Thus, the stacker-printer according to the invention provides two or more levels separation of tags into batches and into groups of batches, and if desired, additional levels of separation may be provided, for example, by providing a medium length tag (e.g., $\frac{1}{4}''$ length) such as the tag 21 (FIG. 6). This tag would then be followed by a medium short tag 21'. Also, the extra long tag 19 can be made sufficiently long to permit an order number or other identifying information to be printed at the top of the tag so that the batches of that group can be identified by order number or otherwise. This identifying information may also be printed elsewhere, such as, for example, the purchase order number printed on the tag 19 of FIG. 6. In this case, the tag may be identified as a header tag as illustrated by the letters HD. TAG printed on the top of the tag 21. Finally, because the tags 17', 19' and 21' are produced only for the purpose of reregistering the web indices 41, they are generally left blank; however, they could contain information if desired.

Because the tags are segregated into batches, it is important that sequence integrity of the tags be maintained to prevent the tags from various batches from being intermixed. However, if a tag becomes caught in the chute 38 and causes other tags to jam up behind it, the sequence integrity can be lost. If a large number of tags jam up in the chute before the jam is detected, the tags must be manually resorted by the operator, a procedure which can be quite time consuming. Therefore, in accordance with another important aspect of the invention, a chute tag sensor 44 is employed to sense the presence of a tag 18 in the chute 38. The sensor 44 can be any suitable sensor, but in the present embodiment is an optical sensor that contains a light source as well as a photoelectric detector to detect the presence of a tag by detecting the light reflected therefrom. The sensor cooperates with a microprocessor within the printer as well as a counter that counts the number of tags that have been printed (both described in a subsequent portion of the specification) to determine the number of tags present in the chute 38. If more than a predetermined number of tags, such as, for example, two or three tags are printed subsequent to the detection of a tag in the chute 38, and a tag is still present in the chute 38, a chute jam condition is indicated and the printing is stopped. Consequently, since only two or three tags need to be sorted after the occurrence of a jam, the operator time necessary to restore sequence integrity is substantially reduced.

A web index sensor 46 is used to sense the indices 41. The indices 41 may be any suitable indices, such as, for example, printed marks, notches or holes, but in the illustrated embodiment, the indices 41 are formed by fluorescent material disposed along one edge of the web 16. The sensor 46 may be any suitable sensor, but in the illustrated embodiment includes a source of ultraviolet light 48 and a photoelectric sensor 50. The source of ultraviolet light 48 excites one of the fluorescent indices along the edge of the web 16 as it passes thereunder and causes it to fluoresce. Because of the relatively slow decay time of the fluorescent material, the fluorescent material continues to fluoresce for some time after being exposed to the ultraviolet light. This fluorescence is detected by the photoelectric detector 50 as the index passes thereunder.

Finally, a conveyor sensor 52 senses the presence of tags thereunder (FIG. 4) and provides a signal indicating the stacker is full and stops the printing process. The sensor 52 is similar to the chute sensor 44 in that it contains a light source and photoelectric detector that detects light reflected from the tags. The sensor 52 may be defeated by lowering a ramp 54 thereover as is illustrated in FIG. 3 in order to prevent the tags from passing under the sensor 52.

Figure 7:
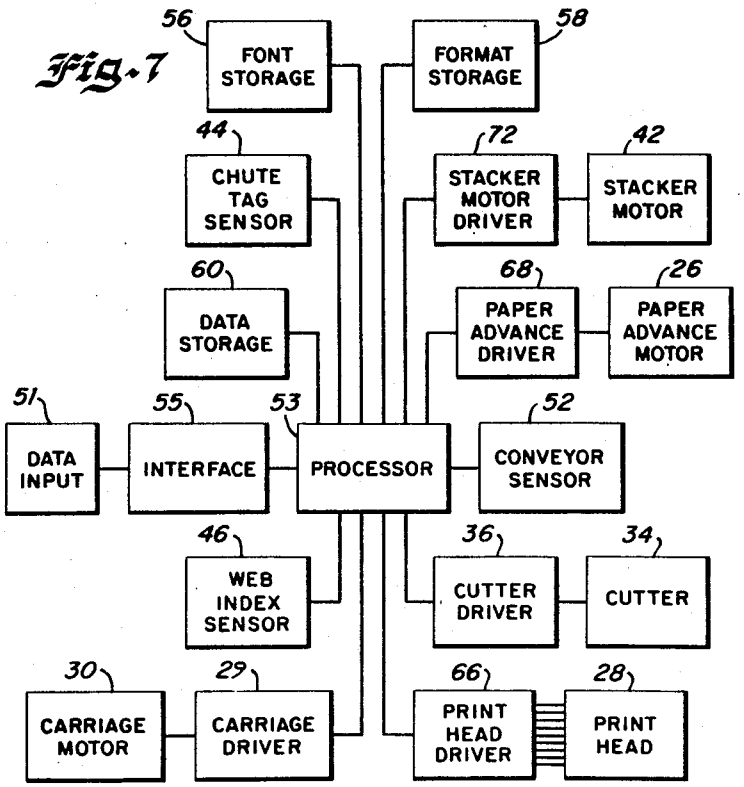
FIG. 7 is a functional block diagram of the control system employed in the printer stacker according to the invention.

Data is input into the printer according to the invention by a data input terminal 51 (FIG. 7) which may be a cathode ray tube data input terminal, another computer or simply a keyboard. The output of the data input 51 may be in various forms, for example, in the form of ASCII characters which are applied to a processor 53 within the printer via an interface 54. The function of the processor is to receive data from the data input terminal 51 and to convert it to a form suitable for driving the print head 28, the web advance motor 26, the cutter 34, the stacker motor 42 and the carriage motor 30 in order to generate the desired characters at the desired positions on the web being printed, to cut the web into tags of appropriate lengths and to stack the cut tags in an appropriate manner.

The system according to the present invention stores various types of information. The information that is stored includes information defining the various fonts, which is stored in a font storage location 56; data defining the format in which a particular tag or label is to be printed, which is stored in a format storage location 58; and data defining the alphanumeric characters that are to be printed, the format that is to be utilized, the number of tags to be printed and the type of stacking required, which is stored in a data storage location 60.

In a typical system, the data stored in the font storage 56 is preprogrammed and generally cannot be changed by data input from the data input 51. The data from the data input 51 merely selects which characters are to be printed. The format storage 58 is programmable by data input from the data input 51 and is used to define the field in which the characters are to be printed. The data entered in the format storage defines the skeleton or outline of the tag to be printed and includes such information as the font of each character, check digits which may be printed, whether or not the line of characters has a fixed length, whether certain characters are always printed, and the location on the tag where the characters are to be printed. In addition, the length and width of the tag necessary to accommodate the selected format is stored in the format storage. This information is printed whenever a new format is selected to assure that the operator has placed the correct size web into the printer. The number of tags to be printed, as well as the number of tag sections to be printed between cuts, is also stored in the format storage 58 in order to control the cutter 34 to cut the tags to the length, and to insert the longer and shorter tags between batches, and between groups of batches, as previously discussed.

The data stored in the data storage 60 includes data representative of the particular characters to be printed on a tag. This data is used in conjunction with the format storage data and font storage data, and printing is controlled by selecting a particular font from the font data storage 56 and a particular format from the format data storage 58. The processor 53 then inserts data from the data storage 60 in the appropriate places defined by the format storage 58 and prints the data in the appropriate fonts defined by the font storage 56. When printing, the microprocessor 53 converts the data stored in the data storage 60, the format storage 58 and the font storage 56 to signals that actually control the printing. These signals take the form of carriage control signals which are amplified by a carriage driver 29 which in turn actuates the carriage motor 30 which controls the movement of the print head 28. Other signals which determine which pins of the print head are to be fired or actuated are amplified by a print head driver 66 and used selectively to actuate the various pins of the print head 28. A paper advance driver 68 amplifies the signals from the processor 53 and controls the position of the paper advance motor 26. A cutter driver 36 amplifies the signals from the processor 53 and causes the cutter 34 to be activated at predetermined intervals as determined by signals from the web index sensor 46 anc the data in the data storage 60 and the format storage 58. A stacker motor driver 72 amplifies signals from the processor 53 in order to drive the stacker motor 42 in accordance with the mode of stacking selected (shingle or pile) and the data in the format storage 58 and the data storage 60. The processor 53 also receives signals from the chute tag sensor 42 and the conveyor sensor 52, and terminates the printing in the event of a jam in the chute or a full stacker.

Stacker-Printer Operation and Logic

The mode of operation of the stacker-printer can be selected by the operator by any suitable input to the data input 51. In the illustrated embodiment, the stacker-printer is designed to operate in four modes which may readily be selected by the operator via the data input 51. The four modes are a shingle only mode, a shingle mode with batch separation, a shingle mode with an extra long tag and printing at the top of the extra long tag, and a stack in piles mode where up to 30 tags may be stacked in a single pile.

Figure 4:
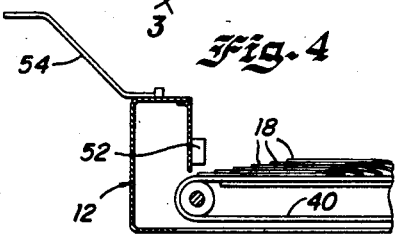
FIGS. 3 and 4 are sectional views of the stacker taken along line 3—3 of FIG. 2 and showing two different modes of operation of the stacker.

In the shingle only mode, tags exit the exit chute 38 and slide onto the conveyor belt 40 as illustrated in FIG. 1. In this mode, each time a tag exits the chute 38, the conveyor belt 40 is incremented a predetermined amount, generally on the order of approximately $\frac{1}{4}''$, to achieve the shingle effect. In this mode, the ramp 54 may be lowered to the position illustrated in FIG. 3 to permit the tags to be turned upright to permit a large number of tags to be stored in the stacker. Alternatively, the ramp 54 may be placed in an upward position as illustrated in FIG. 4 to permit the tags to be sensed by the sensor 52 when the stacker is full.

The shingle mode with batch separation is similar to the shingle only mode except that the last tag of a batch is made longer, for example, $\frac{1}{8}''$ longer than a normal tag. The long tag is followed by a tag that is, for example, $\frac{1}{8}''$ shorter than a normal tag. The short tag is preferably a blank tag.

The shingle mode with the extra long tag with printing at the top is similar to the shingle mode with batch separation except that the extra long tag is longer than the long tag used in the batch separation mode, for example, $\frac{1}{2}''$ longer than a normal tag. The extra long tag is followed by an extra short tag that is, for example, $\frac{1}{2}''$ shorter than a normal tag. In addition, the very top of the extra long tag may be imprinted with information identifying the tag as a header tag, or identifying a batch number or an order number in order to permit the tags to be readily identified. The shingle mode with the extra long tag may be used in conjunction with the shingle mode with batch separation to provide two levels of separation, for example, separation between batches by means of the long and short tags, and separation between groups of batches or orders by means of the extra long and extra short tags. This permits the operator to identify orders and separate batches with minimal effort, particularly when an order contains a large number of small batches. Also, as previously discussed, additional levels of separation may be provided by utilizing separation tags of various lengths.

In the batch separation mode and in the extra long tag mode, the web 16 is advanced by the paper advance motor 26 until an index mark is sensed by the sensor 46. When a long, extra long tag or other length separation tag such as a medium length tag is called for, the web 16 is then advanced the appropriate additional length required for a batch separation tag, an extra long or medium length tag, and printed at the top or not printed as mode requires. In this mode, the ramp 54 may be positioned either down or up as shown in FIGS. 3 and 4, respectively.

Figure 13:
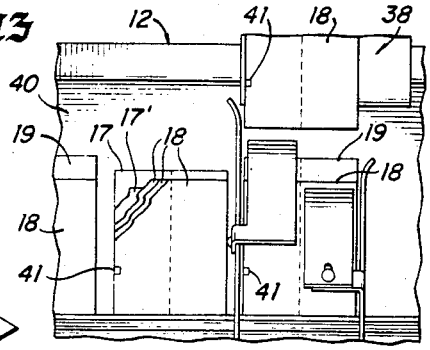
FIG. 13 is a partial illustration of the stacker showing the stack in piles mode of operation.

In the stack in piles mode, the conveyor belt 40 is not advanced after each tag is printed as in the case the shingle modes, but rather, the conveyor belt 40 remains stationary until any desired number of tags up to, for example, 30 tags, are printed. After the desired number or the 30 tags have been printed, or after a batch is completed, the conveyor belt 40 is advanced by an increment approximately equal to or slightly greater than the width of the stack tags, and a new pile is started as shown in FIG. 13. By advancing of the conveyor 40 an amount tailored to suit the width of the tags being printed, maximum density within the stacker is achieved. In the stack in piles mode, the ramp 54 is preferably maintained in the raised position as illustrated in FIG. 4 to assure that the printing is terminated when the stacker is filled and a tag is sensed by the sensor 52. With the ramp 54 raised as shown in FIG. 4, the stacker cannot be over-filled and cause the stacks to be piled on top of each other.

The logic employed in the control of the stacker to achieve the four modes described above is illustrated in FIG. 8 and described below. As can be seen from FIG. 8, after the mode of operation has been loaded into the system, the processor 53 determines which mode has been selected. For example, in the logic illustrated in FIG. 8, the system first determines whether the mode is a batch separation mode. If a batch separation mode has been selected, the system determines whether the last tag of the batch is being printed. If it is not the last tag of the batch, the tag is cut after being printed, and the conveyor belt 40 of the stacker is incremented. The next tag is then checked to determine whether it is the last tag of the batch. If it is the last tag of the batch, a determination is made whether the printing of the tag has finished. When it has finished printing, the web index sensor 46 and the paper advance motor 26 are activated until the web index is found. After the web index is found, the web is fed an additional length equal to the long tag increment and cut. Finally, the web is advanced to the next index and cut again to produce the short tag, and to resynchronize the indexes. The program then returns to the start.

If the batch separation mode is not loaded, a determination is made whether or not the extra long tag mode (or medium long tag mode) has been selected. If the extra long tag mode (or medium long tag mode) has not been selected, a determination is made whether the stack in piles mode has been selected. If the stack in piles mode has not been selected, the tag is cut and the stacker is incremented to provide the shingle mode of operation. However, if the stack in piles mode has been selected, a tag counter is incremented. The count in the tag counter is then compared to determine whether the count is equal to the desired number or the maximum number of tags in a pile, for example, 30. If not, the tag is cut without advancing the conveyor belt 40. However, if the tag count is at the desired number, at its maximum, or the tag being printed in the last tag in a batch, the tag is cut and the conveyor 40 is moved by an amount approximate to or slightly greater than the width of the web of sheet stock in the machine.

If the extra long tag mode (or medium long tag mode) has been selected, a determination is made as to whether the tag being printed is the last tag of the group. If not, the tag is cut and the conveyor belt 40 of the stacker is incremented. If it is the last tag, a determination is made as to whether the last line on the tag is being printed. If not, printing continues until the last line is reached. When the last line is reached, the web index sensor and the paper advance motor are activated until the next web index is found. After the web index is found, and if printing is called for, the tag is incremented by the extra long tag increment, the last line is printed on the end of the tag in the area that corresponds to the top of the extra long tag. The tag is then cut and the web is advanced until the next index mark is found. At this point, the web is cut to produce the extra short tag and to resynchronize the web indices.

Chute Jam Detection

As previously discussed, in order to retain the sequence integrity of the tags exiting the chute 38, a jam in the chute must be detected quickly. However, any detection system must be able to accommodate the large variations in the speed of the tags passing through the chute without falsely indicating a jam when no jam exists, such as could occur, for example, when a slow speed is tag detected. To achieve this function, an event counting system has been developed. In this system, the chute sensor 44 determines whether a tag is present in the chute while the next tag is being printed. If a tag is present, a counter is incremented once, and the count of the tag being printed is noted. If a tag is still present in the chute after that tag has been printed and the subsequent tag is being printed, a chute jam condition exists, and printing is terminated after the tag being printed is completed. The jam condition must be corrected by the operator before printing can be resumed. Thus, the jam condition is detected after only two tags (or any desired number of tags, for example, 1 to 4) have been printed subsequent to the occurrence of the jam.

Figure 9:
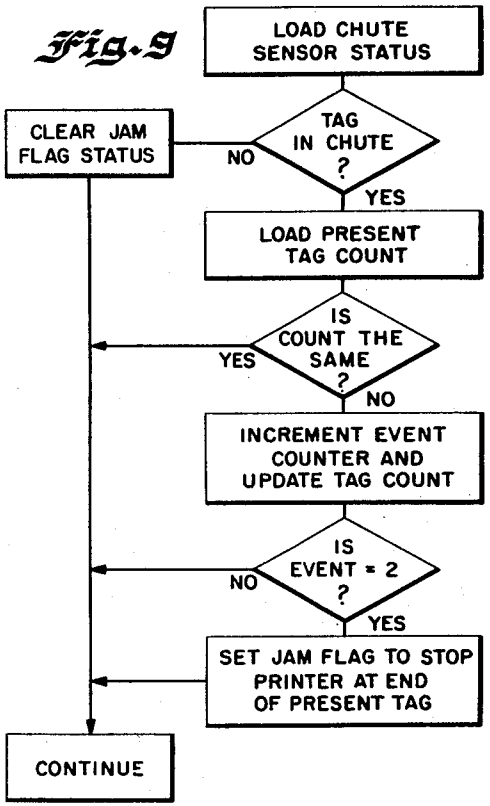

The logic associated with the chute jam detection system is illustrated in FIG. 9. As illustrated in FIG. 9, the status of the chute sensor 44 is monitored. If there is no tag in the chute, any jam flag that may have been previously set is cleared, and the system continues to monitor the chute status. When a tag is detected in the chute, the present tag count is loaded into a counter and compared with a previously loaded tag count. If the count is the same, indicating that no new tags have entered the chute since the presence of a tag in the chute was detected, no action is taken, and the system continues to monitor the status of the chute sensor 44. If the count is not the same, indicating that an additional tag has entered the chute since the presence of a tag in the chute was first detected, the event counter and the tag count are updated. The event counter is then sampled, and if the count in the event counter is less than two (or any other suitable number such as 1, 3, 4, etc.), no action is taken, and the monitoring of the chute sensor continues. However, if the number in the event counter is equal to two (or whatever number has been selected), a jam flag is set to instruct the printer to stop printing at the end of the tag currently being printed.

Stock Width and Length Check

The width and length check is employed whenever a change in format occurs between batches. When a format change occurs, the length and width of tags necessary to accept the format are calculated and compared with the length and width of the stock previously loaded into the printer. If the stock loaded in the printer is not compatible with the requirements of the new format, information defining the necessary length and width is printed onto the stock then in the printer in a format small enough to fit onto the smallest stock that can be accepted by the printer. Printing then terminates, and the operator must load new stock into the printer before printing can resume. Thus, the system minimizes the chance of damage to the print head which can occur as a result of printing directly on the platen, and also minimizes possible damage to the ribbon and wasted supplies.

Figure 2:
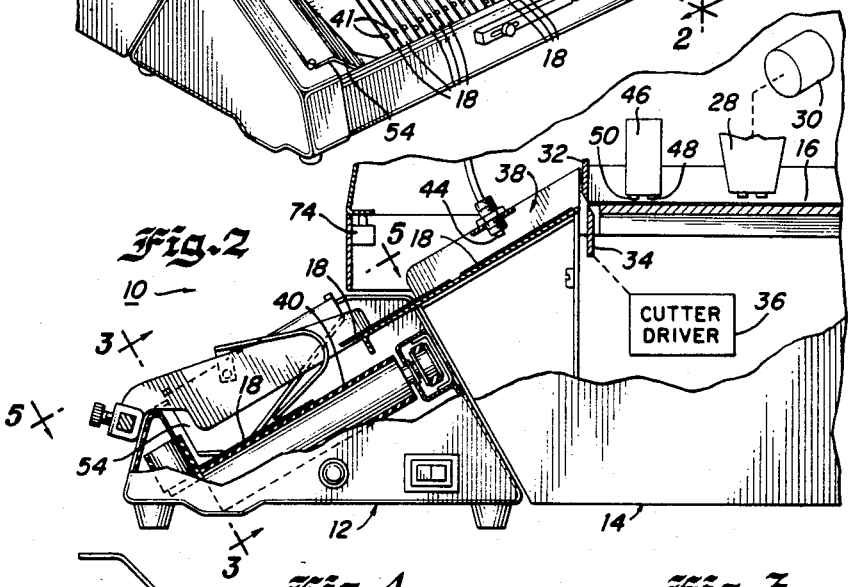
FIG. 2 is a side sectional view of the stacker taken along line 2—2 of FIG. 1.

The above function is performed by the system which compares the length and width requirements of the new format stored in the format storage 58 with the length and width requirements of the format of the previously printed batch. If the values are not the same, the message with the correct values is printed. A sensor senses the position of an out of stock switch (not shown) or a printer carriage open switch 74 (FIG. 2) to determine that the stock has been changed. The operator then enters data defining the width of the stock just loaded into the system via the data input 51. Alternatively, a width sensor (not shown) that automatically senses the width of the web may be provided. The length information is determined directly from the newly loaded web by sensing the distance between web indices on the stock via the web index sensor 46. If the width and length information thus loaded now concurs with the requirements of the selected format, printing may proceed. If not, the tag length and width required by the selected format is again printed on the web and printing is terminated.

Figures 10, 11:
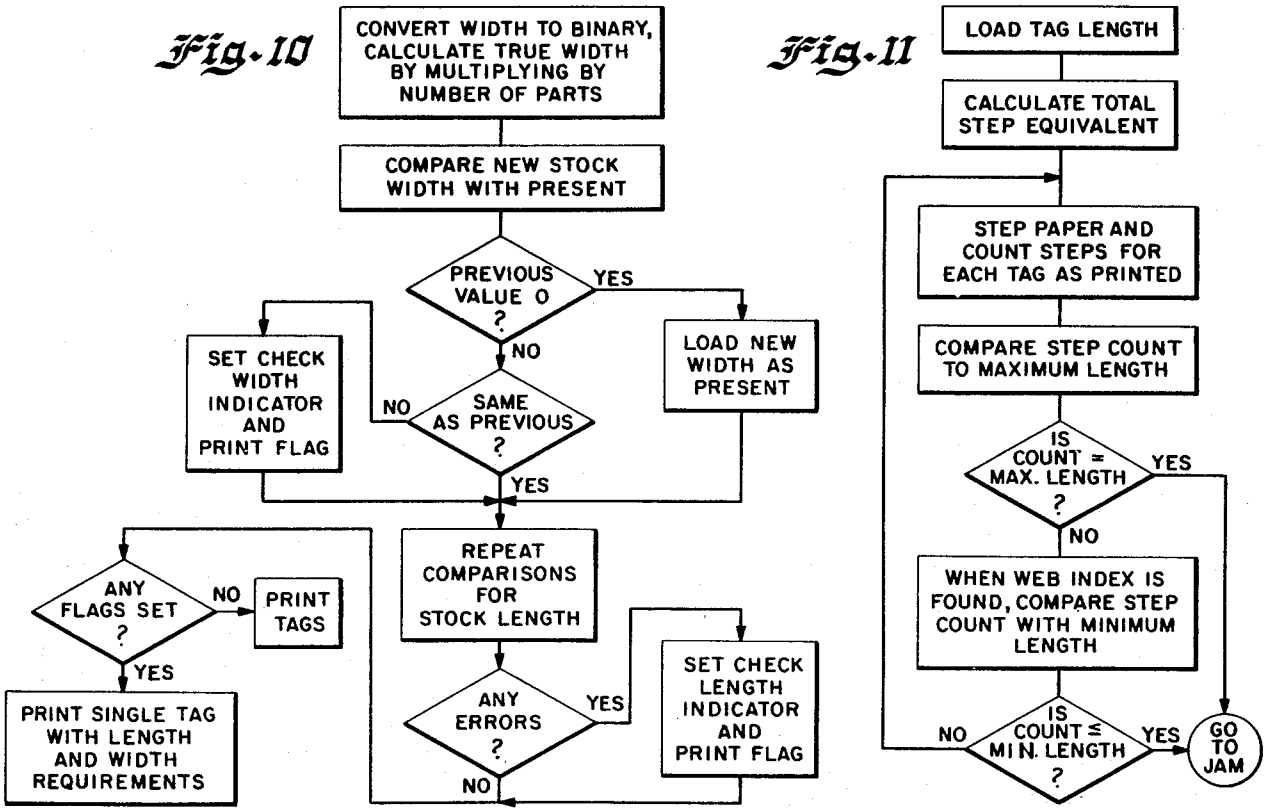

The logic employed by the stock width and length check is illustrated in FIG. 10. As illustrated in FIG. 10, the required width is converted to binary and true width is calculated by multiplying the width requirements of the format stored in the format storage 58 by the number of parts forming the tag in the event that a multiple part tag is being printed. For example, if two-part tags such as those illustrated in FIG. 6 were utilized, the format width requirement would be multiplied by two. The required stock width is compared with the width of the stock presently loaded in the machine. At the same time, a determination is made as to whether or not the previous value of stock width was zero, with zero indicating either that new stock was put into the machine or that a power up condition exists. If the previous value is zero, the new width is loaded as the present width, and the stock length comparisons are made. If the previous value of width is not zero, the comparison between the previous and present stock width is made. If the two values are the same, the stock length comparisons are made. If not, the check width indicator and the print flag are set before the stock length comparisons are made. After the stock length comparisons are made, if there is an error, the check length indicator and the print flag are set. A determination is then made as to whether any flags are set. If not, the printing of tags commences. If a print flag indicative of an incorrect width or an incorrect length has been set, a single tag with the tag length and width requirements required by the selected format is printed. The printing of length and width information is done in a format that can be accommodated by the smallest tag that can be utilized by the printer. No further printing occurs until the stock is changed.

Automatic Length Detection

The stock length check described above, provided automatically by automatic length detection circuitry assures, that the length of the tag stock loaded in the machine is compatible with the selected format to thereby minimize the possibility of printing onto wrong or faulty stock. The detection is automatically achieved by comparing the spacing between web stock indices with the spacing required by the selected format.

The logic for accomplishing the length detection is illustrated in FIG. 11. As is illustrated in FIG. 11, the required tag length, as determined by the format storage 58, is loaded and the number of steps that must be applied to the paper advance motor 26 to advance the web 16 an amount equal to the required tag length is calculated. The web 16 is then advanced, and the steps are counted as each tag is printed. The counts are then compared to a stored step count representative of the maximum length of tag that can be tolerated by the system. If the step count reaches a number representative of the maximum length, a jam condition is indicated. As long as the step count is less than the maximum length representative count, the web index sensor 46 is monitored until a web index is found. When the web index is found, the step count present at the time the web index is detected is compared with a stored count indicative of the minimum length of tag usable with the selected format. If the count is less than or equal to tne count corresponding to the minimum length of tags that can be utilized with the selected format, a jam condition is indicated. If not, the monitoring continues.

When printing a large number of tags, it is useful to run several printers simultaneously, with one of the printers being utilized as a master printer to control one or more remote printers. However, one problem that arises when several printers are being run simultaneously is that, because of variations in mechanical tolerances between the printers, the tags printed by the various printers do not have identical print placement. This occurs because the increment that the web 16 is advanced by the stepping motor 26 in response to a given number of pulses varies from printer to printer. An error as little as 0.0005 inch per step can accumulate over the length of a tag to produce unacceptable printing, with print placement variations between printers varying as much as ±0.20 inch over a two inch long tag. This variation is readily noticeable, particularly when several printers are being operated simultaneously, because the tags produced by the various printers can be readily compared.

One possible solution to this problem is to adjust the various printers by adding or subtracting a fixed increment from the amount that the tag is advanced prior to the printing of the first line or some other line. However, this solution is not entirely satisfactory because the variation in line placement is not fixed. Rather, because the variation in line placement is the result of the accumulation of minute errors that occur during each step of the advance, the line placement error varies as a function of line position, with the error being greater for line positions corresponding to greater tag advance positions than for line positions corresponding to lesser tag advance positions.

Therefore, in accordance with another important aspect of the invention, there is provided a system that can adjust the printer so as to control the print placement from printer to printer to within a tolerance of ±0.010 inch. This is accomplished by varying the position of each line on a dynamic basis as a function of the position of the line relative to the top or bottom of the tag.

Figure 14:
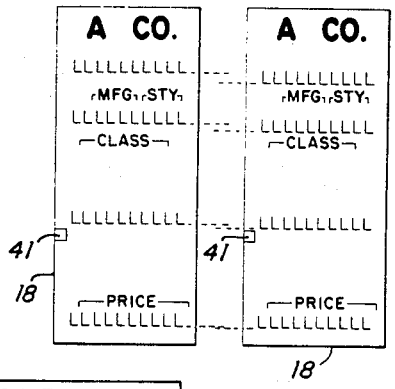
FIG. 14 is an illustration of two tags showing the effects of the dynamic print line compensation feature of the invention.

The effects of the accumulated error resulting from mechanical tolerances as well as the effects of the dynamic correction are illustrated in FIG. 14. Two representative tags are illustrated in FIG. 14, with the tag on the left having been printed without the correction, and the tag on the right having been printed by a printer utilizing the dynamic correction according to the invention.

In the tags illustrated in FIG. 14, a several lines of print, as represented by a series of L's, are printed on each tag near associated lines of preprinted material relating to price, manufacturer, style and other information. When printing lines of information on such preprinted tags, it is desirable to print the various lines of information near the associated preprinted lines; however, because the spacing between the lines of the preprinted material is fixed while the spacing between the lines printed by the printer varies as a function of the mechanical tolerances of the printer, the distance between the lines of preprinted material and the lines printed by the printer varies as a function of the position of the printed line on the tag. This phenomenon is illustrated in the left tag 18 of FIG. 14 which shows the line of print associated with the term "PRICE" to be printed fairly closely to the word "PRICE", while the line of print above the word "CLASS" is spaced further from the preprinted line "CLASS", and the line printed above the preprinted line "MFG STY" is even more spaced therefrom. Thus, it is apparent that any adjustment for printed error must be provided on a dynamic basis in order to obtain equal spacing between the preprinted and printed material. Such dynamic correction is illustrated in the right tag 18 of FIG. 14 which employs the dynamic correction according to the present invention described below.

In order to determine whether a particular printer requires feed distance compensation, a tag having calibrations printed thereon is fed through the feed printer. A calibration format is entered into the printer, and one or more tags are printed. The tags thus printed are then examined to determine whether the data printed on the calibrated tag is located at the proper position as defined by the format. If so, no feed distance compensation is required. If not, the required compensation can be deduced from the calibrations on the calibrated tag. The compensation takes the form of a number which is a submultiple of the total number of steps that the web must be advanced before the desired line position is reached. This number is entered into each printer, and serves to modify the format data that defines the position of each line to be printed received from the master printer. This number may conveniently range from zero to seven so that it may be stored in a three-stage shift register. In addition, a plus or minus indication may be stored in a fourth register stage to indicate whether the number stored in the other three stages is to be used to increase or reduce the amount of the tag advance increment between lines. In a practical system, the number may be entered manually by a switch on the printer which may conveniently be a four-stage switch such as the switch 76 which contains four binary switches (FIG. 1) or any other suitable switch. In the illustrated embodiment, three switches of the switch 76 define the magnitude of the error indication, and the fourth switch defines whether the error indication is positive or negative.

Figure 12:
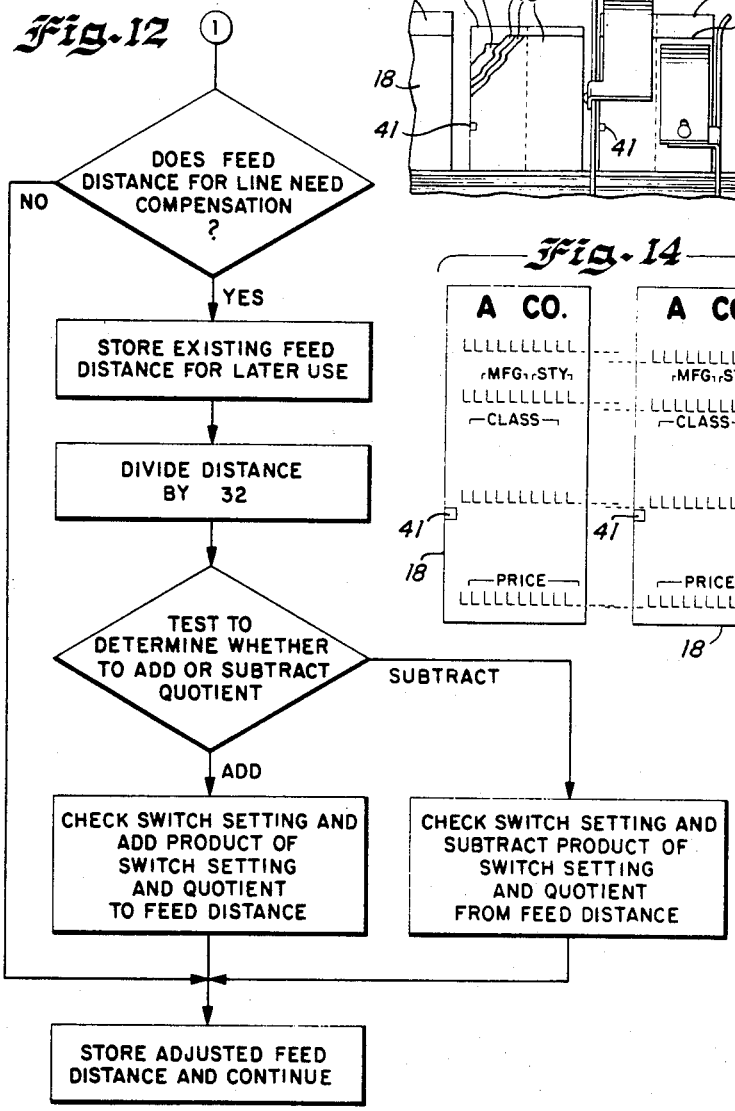

The operation of the feed distance compensation system according to the invention can be best explained with reference to FIG. 12. As illustrated in FIG. 12, the system first determines whether any feed distance compensation is necessary. This determination is made by checking the compensation number entered into the printer. For purposes of discussion, this number will be referred to as a "switch setting", with the "switch" taking the form of a three-stage binary switch having a range of switch settings from zero through seven. In such a system, the determination of whether or not feed distance compensation is required can be readily ascertained by noting the switch setting. If the switch setting is zero (or 000 in binary form), no compensation is required. If the switch setting is anything other than zero, compensation is required.

As previously stated, the system according to the invention serves to adjust the line feed distance by modifying the advance increment called for by the format of the tag being printed by a submultiple of that distance as determined by the switch setting. Thus, if no compensation is required, the advance increment or feed distance called for by the format and expressed as a discrete number of stepping motor steps, is stored in an unmodified form and used to control the advance increment or feed distance of the printer.

If modification of the feed distance is required, the feed distance for a particular line, as determined by the tag format, is temporarily stored so that it can be modified by the system. In the illustrated embodiment, this feed distance is divided by a predetermined integer to provide a number representative of a submultiple of the feed distance. In the illustrated system where the switch setting ranges from zero through seven, a convenient number for the integer by which the feed distance is to be divided is thirty-two. This permits the feed distance as determined by the master printer to be increased or decreased by increments of 1/32 of the feed distance, ranging from no adjustment to increments of up to ±7/32 of the feed distance. If coarser or finer increments are desired, the integer by which the the feed distance is divided as well as the number of stages in the switch may be adjusted accordingly.

Once the feed distance has been divided by thirty-two, a test is made whether or not the original feed distance is to be increased or decreased. This is accomplished by determining the state of the fourth stage of the switch. For example, if the fourth stage of the switch indicates that the feed distance is to be reduced, an increment as determined by the switch setting is subtracted from the feed distance, whereas if the fourth stage of the switch indicates that the feed distance is to be increased, the increment is added to the feed distance.

The increment that is to be added or subtracted from the feed distance provided by the master printer is determined by multiplying the switch setting by the quotient that is obtained by dividing the feed distance by the predetermined integer (in this case, 32). For example, if the switch setting were, for example, seven, and the feed distance for a particular line as provided by the master printer were, for example, 320 steps, the increment to be added or subtracted would be equal to 70 steps, or 320 divided by thirty-two and multiplied by seven. This increment would then be either added to or subtracted from the feed distance received from the master printer depending on whether the feed distance needed to be increased or decreased. In the present example, if the feed distance had to be decreased, the 70 step increment would be subtracted from the 320 step feed distance to provide an adjusted feed distance of 250 steps (320 minus 70 equals 250). Conversely, if the feed distance had to be increased, a new feed distance of 390 steps (320 plus 70 equals 390) would be calculated. This adjusted feed distance would then be stored in a memory within the individual printer and used instead of the feed distance provided by the master printer. This process would automatically be repeated for each line of print called for by the format until an adjusted feed distance for each line of print would be calculated and stored.

As is apparent from the above description, because the increment by which the feed distance is adjusted is determined by both the switch setting and the feed distance provided by the master printer, the increment varies as a function of the distance of a line of print from the top of the tag. Moreover, such a variable increment is achieved with single setting without the need for a separate switch setting for each format or for each line to be printed. This being the case, it is not critical where the line on the calibration tag used to determine the switch setting is positioned with respect to the top or bottom of the tag. However, as is apparent from FIG. 14, because the correction increment is greater for lines near the top of the tag (those requiring a greater tag advance) than for those near the bottom of the tag (those requiring little tag advance), it is preferable to position the line on the calibration tag near the top of that tag, since this permits small errors to be more readily ascertained.

Obviously, many modifications and variations of the present invention are possible in light of the above teachings. Thus, it is to be understood that, within the scope of the appended claims, the invention may be present otherwise than as specifically described above.

What is claimed and desired to be secured by Letters Patent of the United States is:

1. A stacker for stacking batches of tags issuing from a printer comprising:

means including a conveyor for receiving said tags;

means for counting the number of tags placed on said conveyor;

means for determining the number and width of the tags present in each batch; and means responsive to said counting means and to said number and width determining means for advancing said conveyor an increment that is a predetermined amount greater than the width of the tags in the batch after a predetermined number of tags have been printed or after the end of a batch has been reached, said increment being determined by the width of the tags in the batch being printed.

2. A stacker as recited in claim 1 wherein said conveyor advancing means includes means for selectively altering said predetermined number from 1 to a number greater than 1.

3. A stacker as recited in claim 2 wherein said predetermined number altering means includes means for selectively altering said number from 1 to 30.

4. A stacker as recited in claim 1 wherein said stacker includes means responsive to control signals received from said printer for selectively rendering said stacker operative between first and second modes of operation wherein said stacker is operative to stack in piles in said first mode of operation and to stack in a shingle mode in said second mode of operation.

5. A stacker as recited in claim 1 wherein said stacker includes means disposed adjacent an end of said conveyor for sensing the presence of tags thereon, said sensing means being operative to terminate the operation of said printer and said conveyor when said conveyor is full of tags.

6. A stacker as recited in claim 5 further including a ramp disposed at the end of the conveyor and near said sensor, said ramp being movable between a raised position and a lowered position, said ramp being operative to permit tags to pass thereunder to be sensed by said sensor when in the raised position, said ramp being further operative to raise tags over said sensor when in said lowered position to prevent the tags from being sensed thereby.

7. A stacker as recited in claim 1 wherein said increment is greater for wide tags than it is for narrow tags.

* * * * *